United States Patent [19]

Heider et al.

[11] Patent Number: 4,547,087

[45] Date of Patent: Oct. 15, 1985

[54] MICROPROCESSOR-CONTROLLED PRINTING MECHANISM HAVING AN OPTO-ELECTRONIC SENSOR

[75] Inventors: Ulrich Heider; Hans Kern, both of Munich, Fed. Rep. of Germany

[73] Assignee: Siemens Aktiengesellschaft, Berlin & Munich, Fed. Rep. of Germany

[21] Appl. No.: 563,814

[22] Filed: Dec. 21, 1983

[30] Foreign Application Priority Data

Jan. 20, 1983 [DE] Fed. Rep. of Germany ..... 3301827

[51] Int. Cl.[4] ..... B41J 9/38

[52] U.S. Cl. ..... 400/144.2; 101/93.02; 101/93.03; 400/157.2; 400/157.3; 400/166; 400/167

[58] Field of Search ..... 101/93.02, 93.03; 400/144.2, 157.2, 157.3, 166, 167; 361/153, 154

[56] References Cited

U.S. PATENT DOCUMENTS

| | | | |
|---|---|---|---|
| 4,192,230 | 3/1980 | Blom et al. | 101/93.03 |
| 4,347,786 | 9/1982 | Sweat et al. | 101/93.03 |
| 4,407,193 | 10/1983 | Hall et al. | 400/166 X |

FOREIGN PATENT DOCUMENTS

| | | | |
|---|---|---|---|
| 3116430 | 4/1981 | Fed. Rep. of Germany | 400/157.2 |
| 110274 | 6/1983 | Japan | 101/93.02 |

OTHER PUBLICATIONS

IBM Technical Disclosure Bulletin, vol. 24, No. 11B, (Apr. 1982), pp. 6105–6106; and No. 29, (Feb. 1982), pp. 4823–4827.

Abstract of Japanese Patent Application No. 55-124681, (Dec. 5, 1980).

*Primary Examiner*—Paul T. Sewell

*Attorney, Agent, or Firm*—Hill, Van Santen, Steadman & Simpson

[57] ABSTRACT

A plunger armature printing system incorporates an opto-electronic sensor for sensing the movement of a vane fixed to the armature of the print mechanism. The output signal generated by the sensor is employed to define periods for measurement of the speed of movement of the armature. A microprocessor is employed for supplying accelerating and decelerating pulses to the armature magnet for causing the armature to achieve a preselected printing force, in response to the time intervals between similar signals produced by said sensor, and to return said armature to its rest position rapidly without rebound.

7 Claims, 5 Drawing Figures

| TB1 | | TB2 | | TB3 | | |
|---|---|---|---|---|---|---|
| TX2 | TA | TX3B | JCB | TX2B | JVB | TAB |
| 1 | 1 | 1 | 1 | 1 | 1 | 1 |
| 2 | 2 | 2 | 2 | 2 | 2 | 2 |
| 3 | 3 | 3 | 3 | 3 | 3 | 3 |
| 4 | 4 | 4 | 4 | 4 | 4 | 4 |
| 5 | 5 | 5 | 5 | 5 | 5 | 5 |
| 6 | 6 | 6 | 6 | 6 | 6 | 6 |
| 7 | 7 | 7 | 7 | 7 | 7 | 7 |
| 8 | 8 | 8 | 8 | 8 | 8 | 8 |
| 9 | 9 | 9 | 9 | 9 | 9 | 9 |
| ⋮ | ⋮ | ⋮ | ⋮ | ⋮ | ⋮ | ⋮ |
| | | 19 | 19 | 19 | 19 | 19 |
| 20 | 20 | 20 | 20 | 20 | 20 | 20 |

MICROPROCESSOR-CONTROLLED PRINTING MECHANISM HAVING AN OPTO-ELECTRONIC SENSOR

BACKGROUND

The present invention relates to a printing mechanism having a coil driven armature and more particularly to such a system incorporating an opto-electronic mechanism for controlling movement of the armature.

THE PRIOR ART

Armature magnet systems have been employed for some time as drive mechanisms for print hammers and printing devices, or as drivers for needles in matrix printers. Such a system is illustrated and described in the German OS No. 3,116,430, which describes a system incorporating an infrared light detector for sensing the motion of the armature, in a printer using a type-wheel. The output signal from the light detector is used to control the drive of the armature system. This system is employed to develop signals responsive to the parameters of motion of the print hammer, so that these parameters can be used in the control of the print hammer. However, because of the influence of manufacturing tolerances, and the effect thereof on the acceleration and deceleration of the print hammer, it has not been possible to avoid variations in results.

BRIEF DESCRIPTION OF THE PRESENT INVENTION

It is a principal object of the present invention to provide a driven armature printing mechanism constructed in such a way that manufacturing tolerances and operating conditions have no effect on the printing operation.

This object is achieved in the present invention by use of an opto-electronic sensor for developing a signal corresponding to the travel of a printing armature over predetermined distance, together with means for comparing the detected transit time with a parameter stored in memory. More particularly, a plurality of binary correction values are stored in memory, corresponding to a curve of exciting current which is required for developing a predetermined armature velocity from a measured armature velocity.

This and other objects and advantages of the present invention will become manifest by an inspection of the accompanying drawings and the following description.

BRIEF DESCRIPTION OF THE DRAWINGS

Reference will now be made to the accompanied drawings in which.

DESCRIPTION OF THE PREFERRED EMBODIMENT

Figure 1:
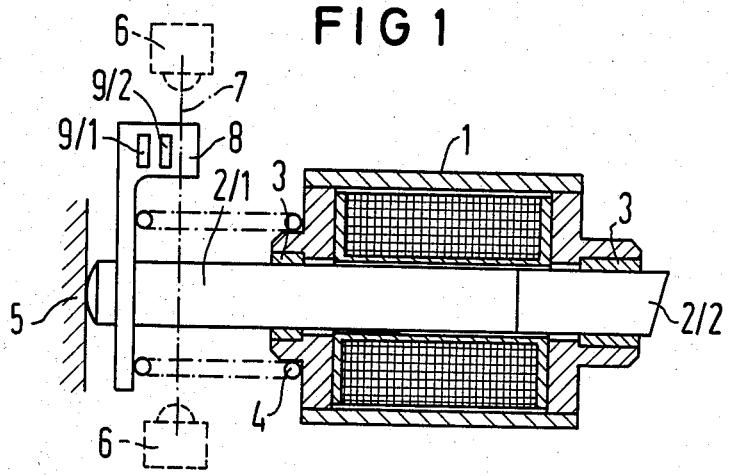
FIG. 1 is a schematic illustration of a printing mechanism incorporating an illustrative embodiment of the present invention, showing an armature in neutral position.

Referring now to the drawings, FIG. 1 illustrates a printing mechanism used especially in connection with a teletypewriter or typewriter. The printing mechanism incorporates a type-wheel (not shown) disposed opposite a platen, and actuated by the printing mechanism shown in FIG. 1. The mechanism incorporates an armature or print hammer 2, surrounded by an exciting coil 1. The print hammer 2 serves as a drive element for pressing a section of the type-wheel against the platen. It consists of a low magnetic retentivity armature 2/1, and a ram 2/2 having low magnetic permeability. The printer hammer 2 is guided for longitudinal movement in bushings 3, and is fixed at its leftward or rest position by a stop 5. A restoring spring 4 is positioned between the bushing 3 and a vane 8, which is fixed to the armature 2/1. The mechanism is illustrated in FIG. 1 in its neutral or rest position. A photoelectric sensor apparatus in the form of a photoelectric switch is disposed adjacent the vane 8 and a light beam 7 extends between a light source 6 and a sensor 6. The vane 8 is fixed to the armature 2/1 in the vacinity of the light beam 7, and has two rectangular apertures 9/1 and 9/2.

Figure 2:
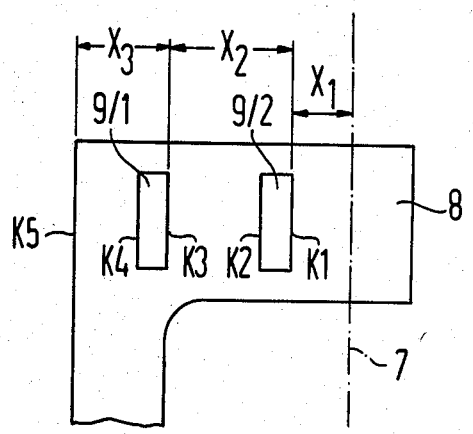
FIG. 2 is a diagrammatic view of a slotted vane connected to the armature.
Figure 5:
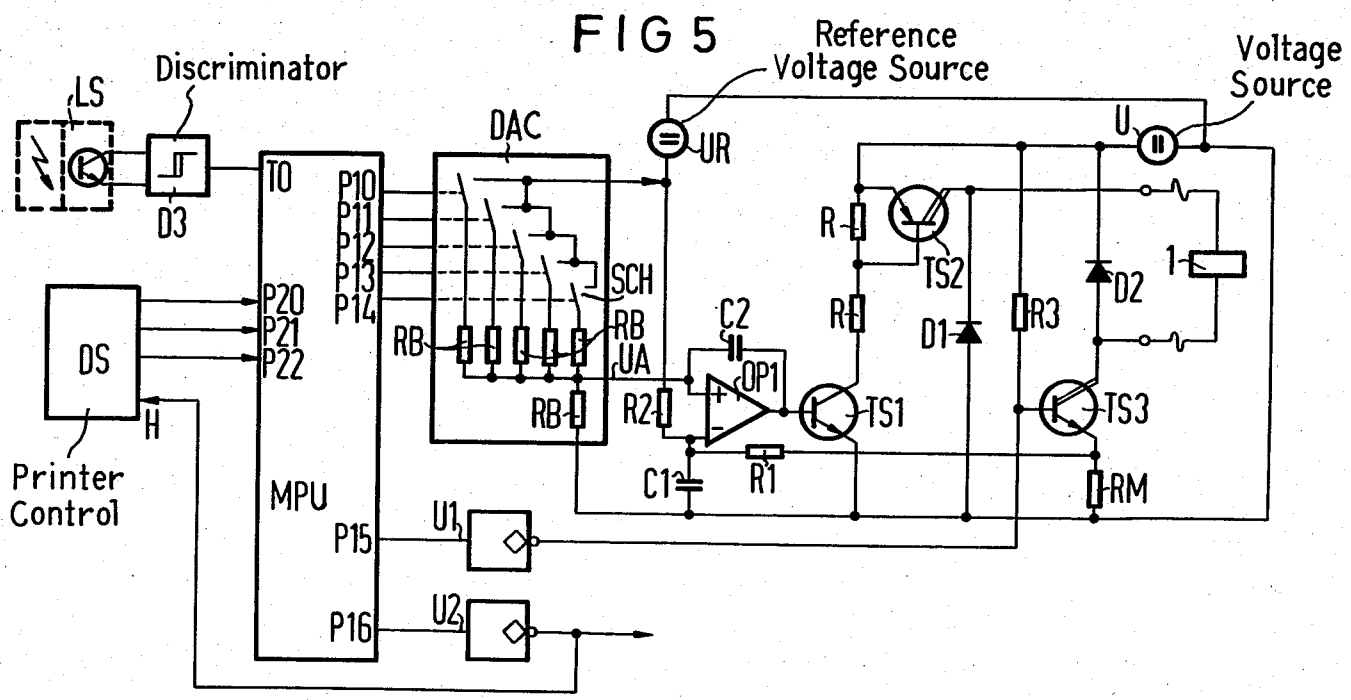
FIG. 5 is a schematic view of a circuit constructed in accordance with an illustrative embodiment of the present invention for operating the armature magnet system.

The magnet coil 1 is driven by means of a drive circuit, such as that shown in FIG. 5, which causes the armature 2/1 to move in an axial direction. FIG. 3*a* illustrates a graph of the motion of the armature, showing the armature moving from its neutral position to the printing position, and then returning to its neutral position, without rebound, after printing. The photoelectronic apparatus 6 senses the slotted vane 8 during the printing operation, and permits evaluation of the speed of travel of the armature over one of several given distances. Such distances are the three deminsions X1, X2 and X3, illustrated in FIG. 2 relative to the slotted vane 8. The distance X1 corresponds to the distance between the normal position of the light beam 7 at rest, and one edge of the slot 9/2. X2 corresponds to the distance between corresponding edges of the slots 9/1 and 9/2, and X3 corresponds to the distance between the same edge of the slot 9/1 and the edge K5 of the slotted vane. During operation of the print head, the slotted vane 8 moves with the armature, and alternately blocks and unblocks the light beam 7, whereupon signals developed in the photoelectric apparatus 6 correspond to specific positions of the slotted vane 8, and the armature 2. The time required for the slotted vane to assume a second specific position from a previous specific position is a function of the velocity with which the slotted vane (and the armature) moves.

The corresponding edges of the slots 9/1 and 9/2 and the edge K5 all represent the same kind of transition, namely, a dark-to-light transition, as the slotted vane moves through the light beam 7. This makes the apparatus insensitive to the change in sensitivity of the photodetector with age, which change can alter the time relationship between signaling a dark/light transition and signaling a light/dark transition. Any change in the sensitivity curve has an equal effect on the determination of distances X2 and X3, for example, since the transition type is the same, i.e., dark-to-light, so that the effect of aging is equal for each determination of the distances X2 and X3.

Figures 3, 4:
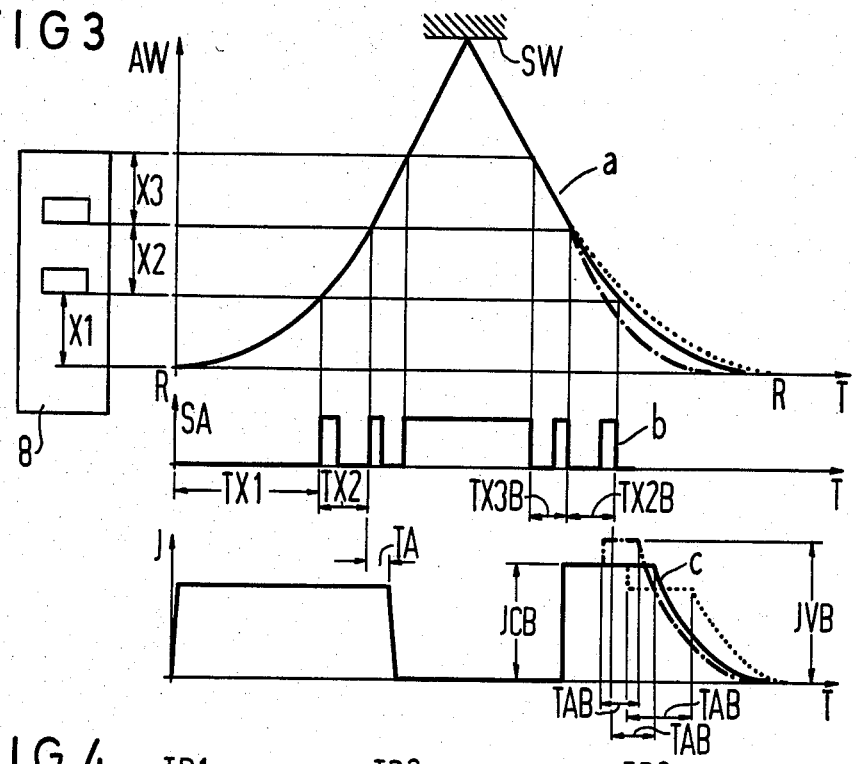
FIG. 3 comprises graphs illustrating operation of the apparatus of FIG. 1.
FIG. 4 is a table representing the relationship between measured values of transit times of the armature and the corresponding digital correction values necessary to arrive at predetermined standard velocity values.

FIG. 3 illustrates the events occuring during a typical printing operation. Three graphs a, b, and c are illustrated in FIG. 3, with the abscissa of each graph corresponding to time T. FIG. 3*a* represents the path of the armature 2 proceeding from a neutral rest position R up the point at which an impression is made against the platen SW, with subsequent return to its initial rest position R. The slotted vane 8, with its relative distances X1, X2 and X3, is also illustrated in FIG. 3*a* and these same distances correspond to ordinates of the graph. FIG. 3*b* shows the amplitude of the signal SA as a function of time, which is produced at the output of the opto-electric sensor apparatus 6, when the path of travel of the armature is that illustrated in FIG. 3*a*. FIG. 3*c* illustrates a graph of the exciting current applied to the armature coil 1 for acceleration and braking, relative to time, when the armature movement is that illustrated in FIG. 3*a*.

The coil 1 is actuated by means of the circuit illustrated in FIG. 5, which contains a microprocessor MP such as a Siemens integrated circuit model number 8048, which has a central processing unit (CPU) and an internal memory for instructions and data.

During movement of the armature printing system of FIG. 1, the motion of the slotted vane 8 is scanned with the assistance of the opto-electronic sensor 6, in order to generate the drive signals for driving the armature. Signals from the opto-electronic sensor LS are applied to the microprocessor MP, and the microprocessor MP furnishes signals to the exciting coil 1 such that the printing hammer has a specific kinetic energy, independent of manufacturing tolerances and external influences. After the printing impression has been made, the armature is decelerated by application of a decelarating pulse to the coil 1, so that it is returned to its rest position quickly, but without rebound, so that a speed of operation is fast and noise-free.

The level of the signal developed by the sensor 6 is inspected periodically, for example, during the initial checkout procedure when the device is switched on, during synchronizing, etc. A check is carried out when the plunger is in its normal position, illustrated in FIG. 1, to determine whether the light beam 7 is interrupted. If not, an error message is issued by the microprocessor MP, to alert the operator to a possible malfunction.

During every printing sequence, the time TX1 required for the vane 8 to traverse the distance X1 is measured and compared to a stored standard time. If the measured time TX1 is longer than the stored time, an error message is generated, and printing is suppressed for a predetermined time such as one second. Then a subsequent printing cycle is initiated. If the measured time TX1 is still excessive, the operation is repeated for a predetermined number of tries, such as three tries, after which, an error message is produced and preferably an alarm device is triggered to alert the operator to a condition in which some long-term malfunction has occured. Then the malfunction can be located and corrected such as a broken wire, a short curcuit of the coil, etc. In case the excessive time is due to a temporary condition, the several retrys of the printing operation prevent a shut-down of the system provided the temporary condition ceases before the last retry.

Similarly, the time TX2 required to traverse a measured length is also measured during each printing operation. For each measurement of the time TX2, an interval TA is selected, and the exciting current I is shut off TA seconds after the measurement of TX2. The relationship between the measured time TX2 and the time interval TA is illustrated in Table TB1 of FIG. 4. The values of 1-20 in column TX2 indicate a sequence of empirically identified actual measured values for the time TX2, corresponding to the time required for the armature to travel the distance X2. These values are stored in the memory in the form of binary code words, and the values 1-20 represent these values symbolically in FIG. 4. Allocated to each of these values is a correction value, which correction values are also stored as a sequence of binary words in association with the binary code words for the times TX2. The code words for the interval TA are illustrated in column TA of Table TB1. The correction values 1-20 of Table TB1, in column TA, are those values which determine the energization time of the coil 1 necessary in order to proceed from the measured value of armature speed to the prescribed rated value, by the time the print head reaches the platen. This is accomplished by means of the circuit arrangement illustrated in FIG. 5.

To this end, after the actual time TX2 is measured, the stored values represented by Table TX2 are consulted, and the corresponding code word from the column TA of the correction value is read from memory and used by the microprocessor to determine the timing at which the current through the coil is shut off. By this means, the kinetic energy of the print armature is made independent of any manufactured tolerances, such as for example, the quality of the magnetic material used with the armature. When the level at the port 15 changes, the switching transistor TS3 is immediately cut off, and the current through the coil 1 is terminated abruptly. In contrast to this operation, when exponential decay of the current pulse is desired, to achieve a soft return of the armature 2 to its rest position R, the value at the port P15 does not change, and the switching transistor TS3 remains conductive. The end of the deceleration pulse TAB is signaled by a change in the values manifested at ports P10–P14. These values change so as to signify a zero value, so that the output voltage UA of the digital-analog converter DA falls to 0. This disables the switching transistors TS1 and TS2, but since the transistor TS3 is still conductive, current continues to flow through the coil 1 and the free-wheeling diode Dl. This current decays exponentially in accordance with the time constant of the circuit.

As described above, the control of the exciting current of the coil 1 is determined by the time sequence of the output signals from the light responsive element LS. Brief disturbances in this input, such as those due to cross-talk from neighboring lines or other influences, can interfere with the correct determination of the mode of operation of the light responsive element LS. In order to suppress such disruptions, the test terminal TO is preferably interrogated twice each time a change in the level at the TO input is manifested, to confirm that the change in level is not due to a momentary condition. In this way, disruptions which may be manifested at the input TOR are eliminated.

From the foregoing discription it will be apparent that the present invention furnishes a simple and effective means for controlling the armature magnet of a printing system. Various additions and modifications in the apparatus disclosed and described will be apparent to those of ordinary skill in the art, without departing from the essential features of novelty of the present invention, which are intended to be defined and secured by the appended claims.

What is claimed is:

1. In a printing system incorporating an armature and a driving coil therefore, said armature functioning as a print hammer and a stop for positively locating said armature in its rest position, the combination comprising;

an opto-electronic sensor juxtaposed with said armature for developing signals in response to movement of said armature, drive means for supplying an accelerating or decelerating pulse to said armature in response to determination of the time required for said armature to travel over a predetermined distance, control means for receiving plural successive signals generated by said opto-electronic sensor and comparing the time interval between said signals with one of a plurality of stored quantities, said stored quantities comprising a plurality of values corresponding to three separate predetermined intervals of motion of said armature, and a plurality of correction values being stored at locations in memory associated with said stored quantities and corresponding to accelerating or decelerating movement of said armature, means for controlling said drive means for accelerating said armature, during an accelerating interval in accordance with said correction values, means for controlling said drive means for decelerating said armature through a first deceleration interval, and for decelerating said armature through a second deceleration interval immediately prior to the armature returning to said rest position, in accordance with said correction values, said correction values corresponding to exciting current required by said drive means to modify the existing value of armature velocity to a predetermined prescribed velocity.

2. Apparatus according to claim 1, including a current control circuit for producing a current pulse corresponding to said correction values, means for supplying a first correction value to said current control circuit during return of said armature from printing position to rest position, said first correction value being identified in response to the time required for said armature to travel a first predetermined distance, said correction value corresponding to a first braking current, and means for supplying a second correction value to said current control circuit over a subsequent distance of travel of said armature, said second correction value corresponding to a second braking current and means for establishing the duration of said second braking current corresponding to said second correction value.

3. Apparatus according to claim 1 including means for controlling said drive means for exponentially decelerating said armature.

4. Apparatus according to claim 1 including a member fixed to said armature and having a plurality of surface edges adapted to sequentially traverse a light beam, said opto-electronic sensor being adapted to respond to sequential sensing of said light beam corresponding to like transitions between light and dark.

5. Apparatus according to claim 4, wherein said member comprises a slotted vane connected to said armature and having aperatures therein with edges which serve as sensing surfaces.

6. Apparatus according to claim 1 wherein said control means includes a microprocessor connected to receive the output signals of said opto-electronic sensor, means for furnishing signals to said microprocessor for defining the desired impression force for said armature, a digital-to-analog converter connected to said microprocessor for receiving a digital representation of the desired drive current, and a current regulator connected to the output of said digital-to-analog converter, said current regulator comprising a switched regulator and differential amplifier for regulating the current in the driving coils as a function of the output signals produced by said microprocessor.

7. Apparatus according to claim 6 including a first semiconductor switch for connecting said driving coil to a voltage source, said switch being connected to receive and be responsive to the output of said differential amplifier, a free-wheeling diode connected to said driving coil and in series with a second semiconductor switch and with a current resistor, said second semiconductor switch being connected to said microprocessor and responsive to a signal therefrom for defining the waveshape of the exciting current, means for connecting the noninverting input of said operational amplifier to the output of said digital-to-analog converter, and means for connecting the inverting input of said operational amplifier to a precision resistor through a voltage divider, whereby said first semiconductor switch is controlled in accordance with a comparison between the voltage produced by said digital to analog converter and the voltage drop across said current resistor.

* * * * *